US005353609A

United States Patent [19]

Hall

[11] Patent Number: 5,353,609

[45] Date of Patent: Oct. 11, 1994

[54] CASKET JEWELRY GUARD APPARATUS

[76] Inventor: Ruby E. Hall, Rte. 1, Box 308, Summerville, Ga. 30747

[21] Appl. No.: 12,763

[22] Filed: Feb. 3, 1993

[51] Int. Cl.[5] ..... A44C 25/00; A61G 17/00

[52] U.S. Cl. ..... 63/2; 27/1; 340/568

[58] Field of Search ..... 63/2; 70/DIG. 49; 27/1; 24/129 C, 129 W, 453; 340/568

[56] References Cited

U.S. PATENT DOCUMENTS

| | | | |
|---|---|---|---|
| 212,273 | 2/1879 | Shannon | 27/1 |
| 344,901 | 7/1886 | Grover | 27/1 |
| 417,569 | 12/1889 | Margileth | 63/2 |
| 2,884,478 | 4/1959 | Becker | 24/129 W |
| 2,913,712 | 11/1959 | Lee | 340/568 |

FOREIGN PATENT DOCUMENTS

| | | | |
|---|---|---|---|
| 724873 | 1/1966 | Canada | 63/2 |

*Primary Examiner*—Flemming Saether
*Attorney, Agent, or Firm*—E. Michael Combs

[57] ABSTRACT

A jewelry guard structure is arranged for securement relative to a casket container, wherein the jewelry guard includes a cable having cable first and second ends mounted within the casket container, with tether lines extending from the cable for securement to jewelry components adorning a corpse and the like within the casket structure. A modification of the invention includes alarm structure to effect audible alarm upon unauthorized tampering of the jewelry component.

4 Claims, 4 Drawing Sheets

CASKET JEWELRY GUARD APPARATUS

BACKGROUND OF THE INVENTION

1. Field of the Invention

The field of invention relates to jewelry guard apparatus, and more particularly pertains to a new and improved casket jewelry guard apparatus wherein the same is arranged to prevent unauthorized tampering of jewelry components within a casket organization.

2. Description of the Prior Art

Jewelry guards of various types are utilized in the prior art, such guard structure has typically been of an opening constrictive nature to minimize ease of frictional and sliding engagement of a jewelry ring and the like relative to an individual's finger. Such structure is indicated in the U.S. Pat. Nos. 4,377,079; 3,518,843; and 4,245,485.

The instant invention attempts to overcome deficiencies of the prior art relative to jewelry components positioned within a casket structure in adorning a corpse member therewithin to positively provide for prevention of jewelry components and their unauthorized removal relative to the casket structure and in this respect, the present invention substantially fulfills this need.

SUMMARY OF THE INVENTION

In view of the foregoing disadvantages inherent in the known types of jewelry guard apparatus now present in the prior art, the present invention provides a casket jewelry guard apparatus wherein the same is arranged to provide for tethering structure to secure each jewelry component relative to the associated casket. As such, the general purpose of the present invention, which will be described subsequently in greater detail, is to provide a new and improved casket jewelry guard apparatus which has all the advantages of the prior art jewelry guard apparatus and none of the disadvantages.

To attain this, the present invention provides a jewelry guard structure arranged for securement relative to a casket container, wherein the jewelry guard includes a cable having cable first and second ends mounted within the casket container, with tether lines extending from the cable for securement to jewelry components adorning a corpse and the like within the casket structure. A modification of the invention includes alarm structure to effect audible alarm upon unauthorized tampering of the jewelry component.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved casket jewelry guard apparatus which has all the advantages of the prior art jewelry guard apparatus and none of the disadvantages.

It is another object of the present invention to provide a new and improved casket jewelry guard apparatus which may be easily and efficiently manufactured and marketed.

It is a further object of the present invention to provide a new and improved casket jewelry guard apparatus which is of a durable and reliable construction.

An even further object of the present invention is to provide a new and improved casket jewelry guard apparatus which is susceptible of a low cost of manufacture with regard to both materials and labor, and which accordingly is then susceptible of low prices of sale to the consuming public, thereby making such casket jewelry guard apparatus economically available to the buying public.

Still yet another object of the present invention is to provide a new and improved casket jewelry guard apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
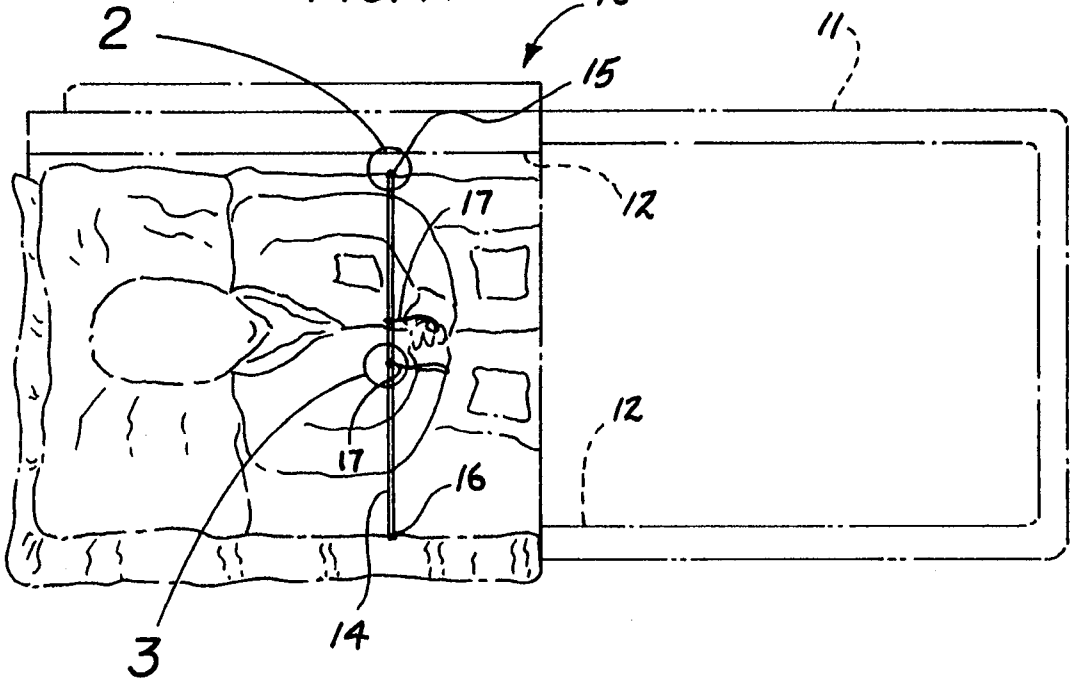
FIG. 1 is an orthographic top view of the casket container and the relationship of the invention thereto.
Figure 2:
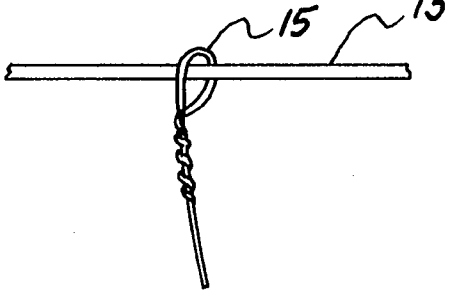
FIG. 2 is an enlarged orthographic view of section 2 as set forth in FIG. 1.

With reference now to the drawings, and in particular to FIGS. 1 to 11 thereof, a new and improved casket jewelry guard apparatus embodying the principles and concepts of the present invention and generally designated by the reference numeral 10 will be described.

Figure 4:
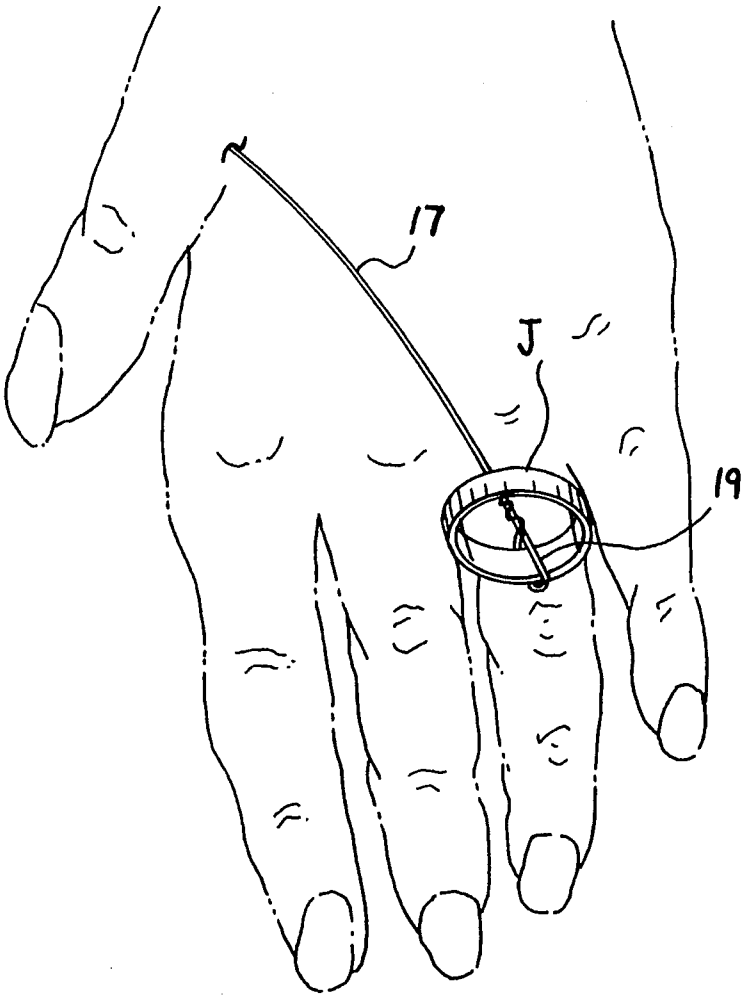
FIG. 4 is an enlarged isometric illustration of the tether line structure mounted to an associated jewelry component within the casket.
Figure 3:
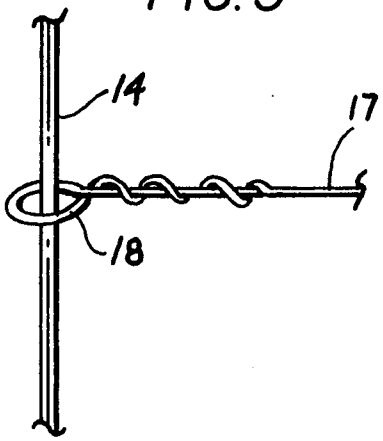
FIG. 3 is an enlarged orthographic view of section 3 as set forth in FIG. 1.
Figure 5:
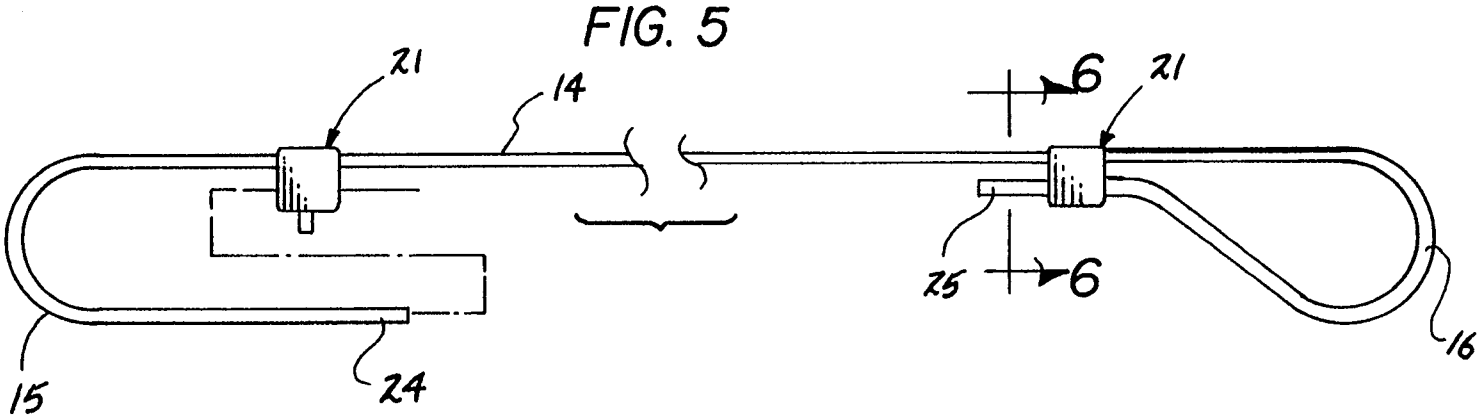
FIG. 5 is an orthographic view of cable lock structure employed by the invention.
Figure 7:
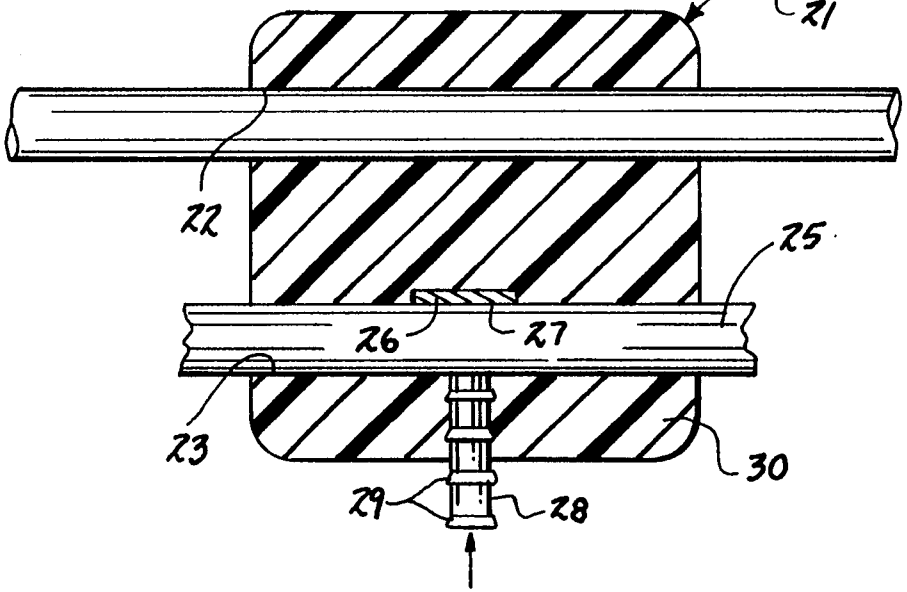
FIG. 7 is an orthographic view, taken along the lines 7—7 of FIG. 6 in the direction indicated by the arrows.
Figure 6:
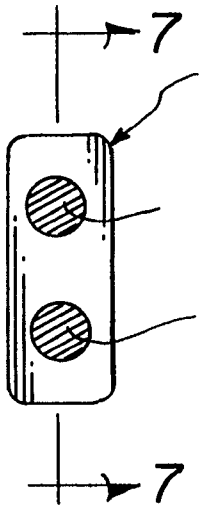
FIG. 6 is an orthographic view, taken along the lines 6—6 of FIG. 5 in the direction indicated by the arrows.
Figure 8:
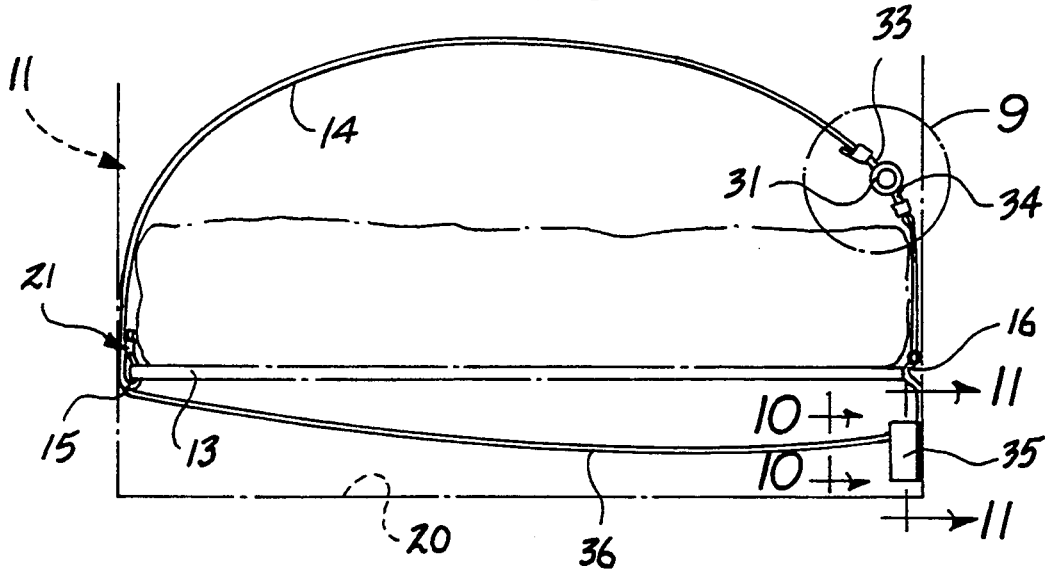
FIG. 8 is an orthographic view of the invention employing an alarm structure.
Figure 9:
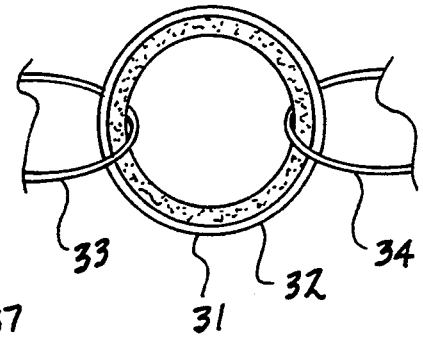
FIG. 9 is an enlarged orthographic view of section 9 as set forth in FIG. 8.
Figure 10:
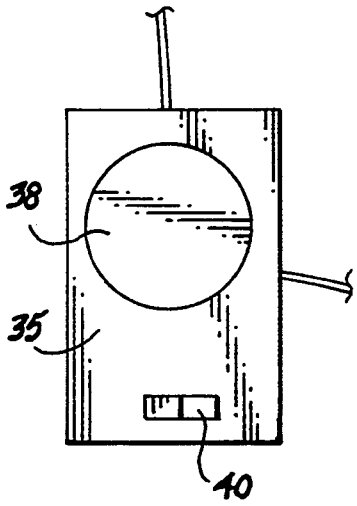
FIG. 10 is an orthographic, taken along the lines 10—10 of FIG. 8 in the direction indicated by the arrows.
Figure 11:
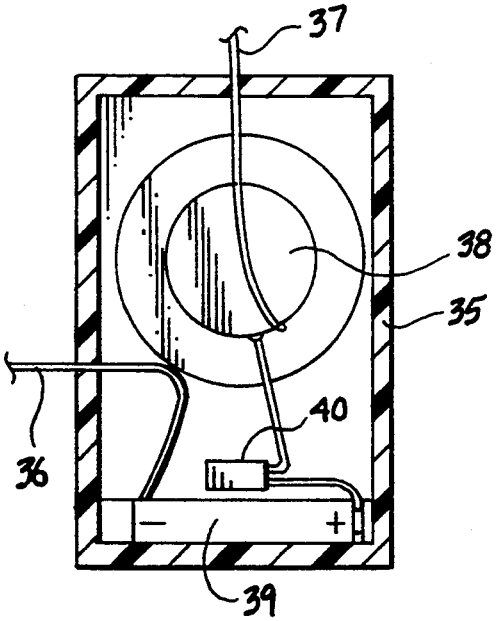
FIG. 11 is an orthographic view, taken along the lines 11—11 of FIG. 8 in the direction indicated by the arrows.

More specifically, the casket jewelry guard apparatus 10 of the instant invention is arranged in association with a casket container 11, having casket side walls 12 and a casket floor 20, as indicated in FIG. 8. The container 11 includes an elongate anchor rod 13, typically of a continuous construction, fixedly mounted within the container 11 in adjacency to the side walls 12 (see FIG. 8). An anchor cable 14 is provided, having an anchor cable first loop 15 at a first end of the cable 14 and a cable second loop 16 mounted at a second end of the cable 14, with the anchor cable 14 extending between the side walls 12, with at least one tether cable 17 having a tether cable first loop 18 mounted to the anchor cable 14 and a tether cable second loop 19 mounted to the second end of the tether cable 17 for securement about a jewelry member "J", in a manner as indicated in FIG. 4. The invention is further arranged to include cable lock housings 21 (see FIGS. 5 and 8 for example), wherein the cable lock housing 21 includes a first bore 22 directed through the housing in a parallel relationship relative to the second bore 23. The first bore 22 slidably receives the anchor cable 14 therethrough. The cable 14 having a cable first end 24 spaced from a cable second end 25 is arranged for forming of the cable first and second loops 15 and 16 respectively. By way of example, the FIG. 6 indicates the cable second end 25 directed through a respective lock housing second bore 23. Within the lock housing and between the first bore and the second bore is an abutment plate 26 in facing relationship to a lock rod 28. The abutment plate 26 includes a roughened facing web 27 to enhance frictional engagement with the cable, wherein the lock rod 28 includes a plurality of spaced conical rings 29 mounted about the lock rod 28, wherein the lock rod housing includes a resilient housing body 30 permitting projection of the lock rod 28 and at least one of the conical rings 29 into the cable housing body 30 to provide for locking and preventing withdrawal of the lock rod 28 relative to the housing body 30 and to thereby engage the cable second end 25 and direct the cable second end towards the abutment plate roughened facing web 27. Each cable housing is of like construction to secure an associated cable end therewithin.

The FIG. 8 indicates the use of an alarm structure, wherein an anchor cable electrically conductive alarm ring 31 is mounted intermediate the anchor cable first and second loops 15 and 16. The alarm ring 31 includes an insulative liner 32 of a readily severable construction such as sponge material and the like. The anchor cable 14 accordingly includes an anchor cable first intermediate loop 33 extending from the first loop 15 and mounted about the alarm rings 31, wherein a second intermediate loop 34 is directed about the alarm ring 31. In this manner, a first cable portion extends from the cable first loop 15 to the first intermediate loop 33 and a second cable portion extends from the second cable loop 16 to the second intermediate loop 34. An alarm housing 35 is provided and arranged in a fixed securement relative to the container 11, with the alarm housing having a first conductive cable 36 directed from the alarm housing 35 to the first loop 15, with a second conductive cable 37 directed from the alarm housing 35 to the second loop 16. The alarm housing 35 includes an audio speaker and amplifier member 38 positioned therewithin in electrical communication with a battery 39 and an on/off switch 40. Upon actuation of the switch 40 and directing the switch to a closed configuration, should unauthorized pulling of the tether cable 17 be effected, tensioning of the first or second cable portions and more specifically, the intermediate loops 33 and 34 relative to the alarm ring 31 effects severing of the insulative liner 32 to complete electrical communication between the anchor cable and the alarm housing effecting actuation of the audible alarm indicating such unauthorized tampering.

As to the manner of usage and operation of the instant invention, the same should be apparent from the above disclosure, and accordingly no further discussion relative to the manner of usage and operation of tile instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A casket jewelry guard apparatus arranged in combination with a casket container, wherein the casket container includes spaced side walls and a casket floor, with an anchor rod mounted within the casket container in adjacency to the side walls, and an anchor cable, the anchor cable including a first loop mounted at a first end of the anchor cable, and a second loop mounted at a second end of the anchor cable, wherein the first loop and the second loop receive the anchor rod therethrough, and at least one tether cable, the tether cable having a tether cable first loop slidingly receiving the anchor cable, and a tether cable second loop arranged for securement about a jewelry member within the casket container.

2. An apparatus as set forth in claim 1 wherein the anchor rod is of continuous configuration.

3. An apparatus as set forth in claim 2 wherein the anchor cable first loop includes an anchor cable first end, and the first loop including a cable lock housing, the cable lock housing having a first bore slidably receiving an anchor cable therethrough, and a second bore spaced from the first bore receiving the cable first end therethrough, and the second bore having an abutment plate mounted between the first bore and the second bore, and a lock rod, wherein the abutment plate includes a roughened facing web in facing relationship relative to the lock rod, the lock rod including spaced conical rings, and the cable lock housing formed of a resilient housing body, wherein the conical rings are arranged for engagement within the resilient housing body when the lock rod is directed into the cable lock housing for capturing of the cable first end intermediate the abutment plate roughened facing web and the lock rod.

4. An apparatus as set forth in claim 3 including an alarm member contained within the casket container, the alarm member includes an alarm housing having an alarm housing first cable directed from the alarm housing to the first loop, and an arm housing second cable directed from the alarm housing to the second loop, wherein the alarm housing includes an audio speaker means therewithin for audibly indicating an alarm, with a battery container within the alarm housing in electrical communication with the audio speaker and the first cable and the second cable, and an alarm ring mounted intermediate the anchor cable, the anchor cable having a first cable portion and a second cable portion, the first cable portion including a first intermediate loop mounted about the alarm ring, the second cable portion having a second intermediate loop mounted about the alarm ring, wherein the first cable portion extends from the anchor cable first loop to the first intermediate loop and the second cable portion extends from the anchor cable second loop to the second intermediate loop, the alarm ring having an insulative liner in surrounding relationship within the alarm ring, whereupon unauthorized tensioning of the anchor cable upon tensioning of the tether cable effects severing of the insulative liner selectively by the first intermediate loop and the second intermediate loop to effect actuation of the audio speaker and audible alarm.

* * * * *